United States Patent [19]

Furmanek

[11] Patent Number: 5,025,633

[45] Date of Patent: Jun. 25, 1991

[54] CFC RECYCLING SYSTEM

[76] Inventor: Daniel J. Furmanek, 5750 Newhouse Rd., E. Amherst, N.Y. 14051

[21] Appl. No.: 561,342

[22] Filed: Jul. 31, 1990

[51] Int. Cl.[5] ..... T25B 45/00

[52] U.S. Cl. ..... 62/77; 62/292; 137/318

[58] Field of Search ..... 62/77, 149, 292; 137/318

[56] References Cited

U.S. PATENT DOCUMENTS

| | | | |
|---|---|---|---|
| 2,827,913 | 3/1958 | Wagner | 137/318 |
| 3,232,070 | 2/1966 | Sparano | 62/149 |
| 3,252,475 | 5/1966 | Jones | 62/292 X |
| 4,363,222 | 12/1982 | Cain | 62/292 |
| 4,458,497 | 7/1984 | Kubik | 62/292 X |
| 4,776,174 | 10/1988 | Rich et al. | 62/292 X |
| 4,776,362 | 10/1988 | Domingue, Sr. et al. | 137/318 X |

*Primary Examiner*—William E. Tapolcai

*Attorney, Agent, or Firm*—James J. Ralabate

[57] ABSTRACT

This invention involves a method for recycling Freon by the use of an appropriate valve that is attached to the Freon source in the appliance. The appliance can be a refrigerator, an air conditioner or any structure using Freon. The valve is so constructed so as to have a puncture means which taps the Freon supply tube or other supply and conveys the Freon into a collection vessel which can be hermetically sealed once the Freon is collected. The collecting vessel is then brought to a collection center where the collected Freon is recycled and reused. This invention provides a valuable ecological function and also an incentive for the reuse of this material.

9 Claims, 3 Drawing Sheets

Fig. 3
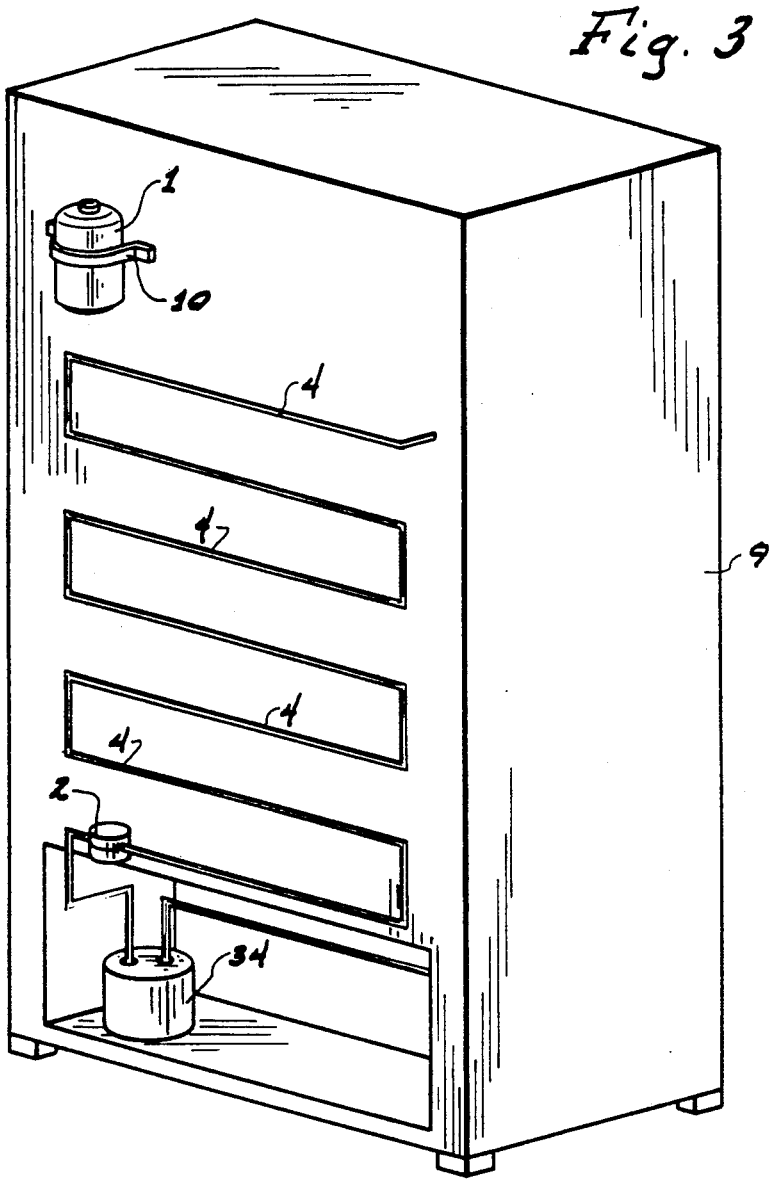
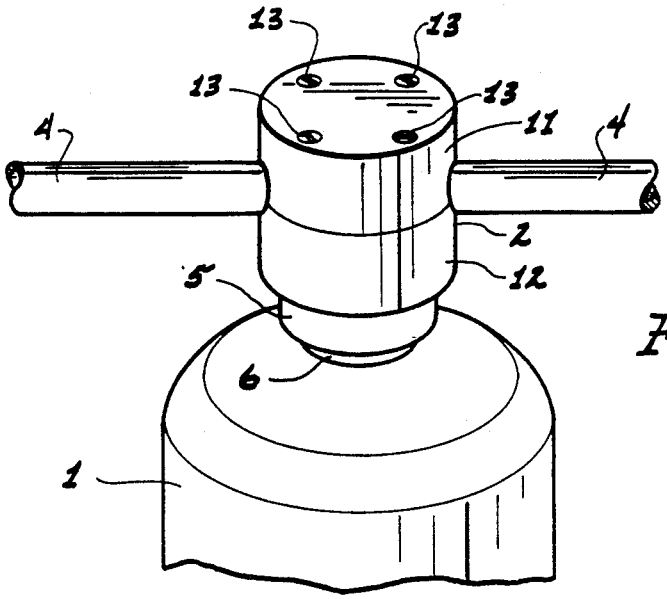
Fig. 4

CFC RECYCLING SYSTEM

This invention relates to a Freon recycling system and, more particularly, to a method and apparatus for the recycling of Freon.

BACKGROUND OF THE INVENTION

Chlorofluorocarbons (Freon or CFC's) have become an environmental problem of major importance. They have been considered to be directly or indirectly responsible for the increase in skin cancer, damage to natural resources, adverse effect on crops and living objects as well as adding to the Greenhouse Effect.

The ozone layer is found in the stratosphere and is responsible for screening out more than 99% of the sun's deadly ultraviolet radiation. CFC's are the prime culprit for the already measurable loss of ozone. The Environmental Protection Agency (EPA) has estimated that a 5% reduction in the ozone would cause an additional 940,000 cases annually of non-melanoma skin cancer (a disfiguring but not usually fatal cancer). They have also estimated an additional 30,000 more cases annually of often-fatal melanoma skin cancer. In 1935, the risk of an American developing melanoma was 1 in 1,500; today it is 1 in 120. NASA has calculated (based on Shuttle Missions and Satellite observed data) a 10% reduction of the ozone by the year 2050. This is based on 1987 emission levels. Even more frightening is the fact that 95% of the CFC's released into the atmosphere between 1955 and today are still making their way up to the stratosphere. CFC's (commonly called by their trade name Freons) are also a "Greenhouse Gas". They are 20,000 times more heat absorbant than $CO_2$ (carbon dioxide).

In areas near coal burning facilities such as power plants a 1% reduction in ozone would increase the production of hydrogen peroxide as much as 80%. Hydrogen peroxide speeds up the formation of sulfuric and nitric acids in the upper atmosphere thus adding to the global acid rain problem.

Increased ultraviolet radiation as a result of ozone loss is also responsible for accelerated degradation of plastics and other polymers, eye cataracts, billions of dollars in food crop damage, aquatic plants that are esssential to ocean food chains and suppression of human and animal immune systems.

On a global scale many countries are aware of this major problem. Many countries have banned all non-essential use of Freon such as styrofoam production and aerosal cans. Our federal government also is aware of the problem. They have recently imposed a tax on Freon that almost doubles the price. This will grow to almost five times that amount by the end of the 1990's. Furthermore, production has been frozen at 1986 levels and will be continually reduced by an additional 50% by the middle of 1998. This was intended to force industry to look for less expensive alternatives as well as being more conservative. Some of the industry seems to feel HCFC's (Halogenated CFC's ) are the answer. However, HCFC's suffer from all the same problems as CFC's but at a slightly reduced rate. Furthermore, implementation of HCFC's would be significantly costly both for the product itself and the complete retooling of the compressor and refrigeration systems. HCFC's seem to be a poor alternative.

A far better alternative is recycling. If a monetary deposit was placed on the Freon inside each system and a kit containing a novel valve and container for removal was provided, Freon could successfully be used and reused without harmful damage to the atmosphere. Furthermore, the average life of a refrigeration system is 7.2 years. The deposit could remain in an interest-bearing bank account that each state and/or federal government could have access to. Each town or municipality could also encounter occasional unclaimed deposits on trash day, further adding revenue.

Freon manufacturers would also profit (thereby eventually saving the consumer money) by having access to inexpensive Freon to recycle rather than having to manufacture it from the raw materials. A recycling program is a quick and inexpensive solution to a very serious problem. Everyone profits from Freon recycling as well as it being beneficial to mankind and preserving our valuable environment.

There have been some attempts to remove and clean Freon from air conditioners before returning it to the system. These prior art systems do not solve the problem of minimizing the escape of Freon to the atmosphere from discarded appliances such as air conditioners and refrigerators. Typical of these prior art systems are the processes disclosed in U.S. Pat. Nos. 3,237,420 (Mulholland); 3,443,392 (Alexander); 4,458,497 (Kubik) 4,761,961 (Marx).

In Mulholland a system is disclosed which includes a condensing section charged with a refrigerant in an amount in excess of the required system charge in consideration of its maximum interconnecting conduit length. The system disclosed by Mulholland is primarily concerned with maintaining a refrigeration system free of contamination. There is no provision in Mulholland for recycling Freon.

In Alexander above cited, a process for the restoration of burned out refrigeration systems is disclosed. In the Alexander system a burned out hermatic refrigeration system may be restored to use through the use of a counterflow of cleaning refrigerant. Again, there is no teaching in Alexander of steps to avoid the escape of Freon to the atmosphere nor to reusing Freon removed from old discarded appliances.

Kubik U.S. Pat. No. 4,458,497 discloses a method of evacuating an air conditioner by using the air/fuel intake manifold of a gasoline internal combustion engine. Kubik is concerned with the replacement of refrigerants from air conditioners and the removal of the old refrigerant before recharging with a new refrigerant. The main problem to be attended to in this invention, that is, the recycling of Freon or any other refrigerant, is not addressed in Kubik.

Marx U.S. Pat. No. 4,761,961 discloses a system to be used on air conditioners during maintenance and repair operations. In his system, refrigerants need to be decanted from their units by a connective pipe. While Marx is attentive to the system's loss of a refrigerant and its adverse effect on the environment, he makes no suggestions on how to utilize refrigerants from discarded appliances.

SUMMARY OF THE INVENTION

It is therefore an object of this invention to provide a refrigerant removal and recycling system devoid of the above-noted disadvantages.

Another object of this invention is to provide a simple efficient method and apparatus for removing and collecting Freon.

Still a further object of this invention is to provide a novel valve and collection vessel to be used for the removal and collection of Freon from Freon-containing appliances.

Another still further object of this invention is to provide a novel system for recycling Freon and minimizing its adverse effect on the atmosphere.

Still yet a further object of this invention is to provide a simple method which would allow the consumer to remove Freon from an appliance before it is discarded.

Yet another object of this invention is to provide a novel method for the recycling of Freon that has built in incentives for everyone to utilize it.

These and other objects are accomplished in accordance with this invention by providing a novel Freon recovery system that not only prevents escape of the Freon to the atmosphere but which also allows for recycling of Freon. This recycling would substantially reduce the amount of Freon in existence and could very effectively solve a pressing environmental problem. When "Freon" is used throughout this disclosure and claims it is intended also to include any other applicable refrigerant.

The present invention provides a method or apparatus for removing at least substantially all of the Freon (chlorofluorocarbon) from refrigeration equipment or other equipment containing Freon. It is specifically intended for smaller applications. These applications include home refrigerators, freezers, air conditioners and automotive air conditioning systems and the like. There are also applications in light commercial practice as well. A principle advantage of the present system is to allow the consumer to remove at least the bulk of the Freon from a refrigeration system before it is discarded. The consumer originally could pay a deposit on the Freon in his or her appliance. The Freon, after removal, is then taken to a collection point where the consumer is reimbursed by the collection company or store for his/her deposit. The kit or apparatus used to remove and recycle consists of two principal pieces. First a novel valve that is placed at the low end (usually near the compressor) of the refrigeration system. This is where the bulk of the liquid Freon is concentrated. The novel valve consists of two halves that sandwich over the refrigeration tubing. It is secured by four bolts (usually Allen type). This will be done by either the manufacturer or the distributor of the refrigeration system.

The valve may come in two variations, the first of which accomplishes a puncture of the refrigeration tubing by simply tightening a screw or bolt that is located on top. The puncture is done by the consumer at the time of Freon removal. The second variation accomplishes a puncture by simply screwing the tank onto the valve securely. The tank is the second part of the apparatus or kit. It has been placed under a vacuum so that when it is attached to the valve it aids in drawing out the Freon. After a few minutes the container is removed and both the tank and the valve are capped for safety. The Freon is now in the container and may be returned to a collection point for deposit.

Both the Freon collection tank and the valve have important structural features in order to effectively carry off the process of this invention. Furthermore, since two basic types of common Freon are used (R-12 and R-22) in home appliances, two different valve/tank systems may be used such as a right-handed thread on the top of one tank and its mate valve and a left-handed thread on the alternate tank/valve system. This feature is intended to prevent the intermix of refrigerants. The tanks must also employ extra internal supports to prevent buckling when placed in a vacuum. When a consumer returns the Freon to a collection store, the store will need to weigh the tank to determine the amount of Freon therein. Deposits can be based on a "per ounce" basis. The collection store must also verify the contents truly being Freon. This may be accomplished with an appropriate test valve and a common Freon sensor such as the halogen leak detector sold by TIF Corporation and identified as TIF Brand Model TIF 5500. The test valve has a button on top. When the button is depressed it pushes on the tank's valve (which had been previously screwed onto the test valve) and allows a minute amount of Freon to escape. This can then be detected by the Freon sensor thereby verifying the contents. Finally, the valve on the refrigeration system must have a safety seal. First, naturally to prevent leakage but also to serve as a visual indicator to show if the Freon has been removed from the refrigeration system. Any suitable valve may be used in the present invention such as that disclosed in U.S. Pat. No. 3,336,937. However, significant alterations would be necessary.

A safety seal that can be used includes a piece of foil that when removed is destroyed. However, any suitable visual indicator may be used. It is glued over the top of the safety cap which is located on the bottom of the refrigeration system.

The collection tank may be constructed of any suitable material such as metal, plastic, fiberglass or the like. It is important that it can withstand the stress of being under vacuum for an extended period of time without any possible leakage and is inert to Freon. The Freon removal valve may also be constructed of any suitable material provided the materials are inert to Freon gas and have the necessary strength and capacity to function with all Freon containing equipment.

BRIEF DESCRIPTION OF THE DRAWING

FIG. 3 is a perspective view of the Freon removal valve as it is attached to a Freon supply tube in a refrigerator upon use and prior to attachment to a container.

FIG. 4 is a perspective of the valve of this invention attached to the container of this invention after during removal and collection from a Freon source.

DESCRIPTION OF THE DRAWING AND PREFERRED EMBODIMENT

Figure 1:
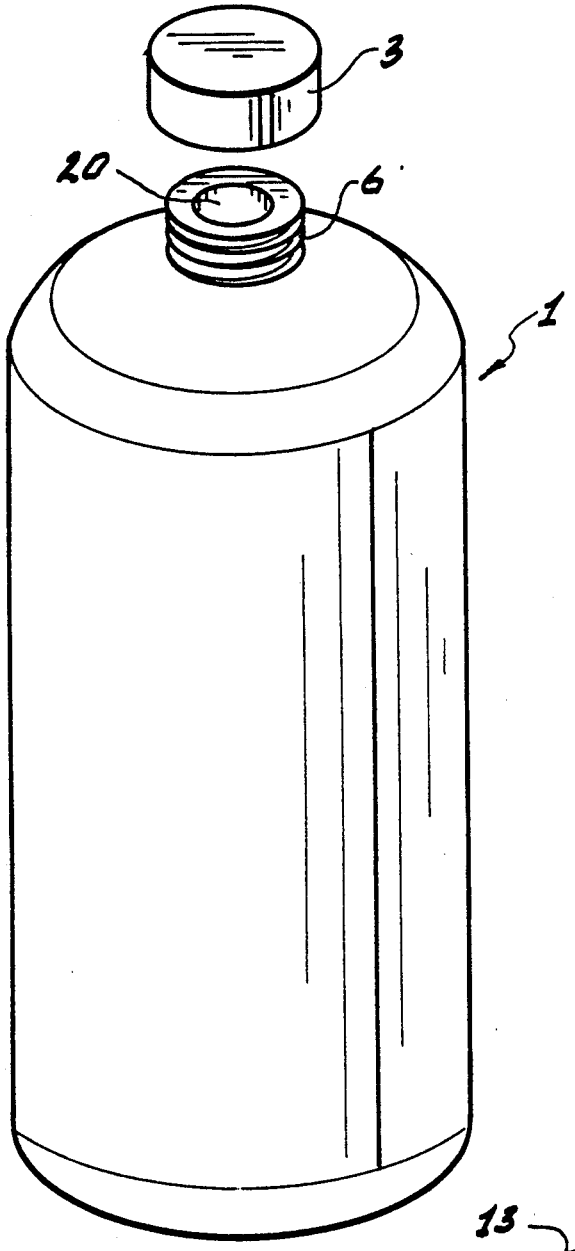
FIG. 1 is a perspective view of a typical container used in the present invention.
Figure 2:
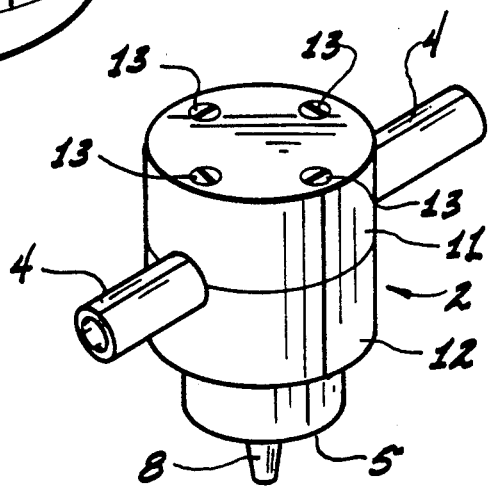
FIG. 2 is a perspective view of the Freon removal valve used in the present invention.

In FIGS. 1 and 2 a structurally strong container 1 is shown in which the Freon is collected from the appliance containing a refrigerant. The container 1 is kept under vacuum to assist in drawing off the Freon when attached to the Freon removal valve 2. The collection vessel 1 is capped with a gastight cap 3 to prevent the loss of vacuum before usage. The cap 3 can be any suitable threaded cap that can be replaced by the valve 2 upon usage or cap 3 can be the valve 2 itself. In the latter case, the valve 2 remains sealed until it is attached to a tube 4 or other means containing the Freon to be removed. When valve 2 is attached to the Freon tube it eventually can be used to puncture the Freon means or tube 4 and also forms a gas flow passage or conduit between the Freon containing tube and the container 1. The puncturing can be effected by merely tightening the tank 1 onto the valve 2 or tightening a puncturing screw on the valve 2. Container 1 being under vacuum will draw the Freon therein and assist in the removal of the Freon from the source of Freon via tube 4. After removal of the Freon, the valve 2 (which is now on the container 1) is turned slightly to make it gastight and prevent any escape of Freon from the container 1. Valve 2 may be fixed upon tube 4 or a source of Freon upon manufacture of the appliance or in lieu thereof it may be provided in a kit with container 1 or may just be supplied by itself to be retrofitted into a tube 4 or Freon source at a later time. In valve 2 is a threaded portion 5 that will screw onto threaded portion 6 of container 1 when the Freon removal step is to take place. Valve 2 has two parts; upper portion 11 and lower portion 12. Screws 13 are loosened to separate portions 11 and 12 when valve 2 is to be installed around tube 4. Screws 13 are then tightened to fix valve 2 in position. As earlier noted, valve 2 can be permanently fixed to container 1 if more desirable, so that the consumer may at the time of removal attach the entire mechanism to the tube 4. After removal of the Freon, container 1 may be sealed by any appropriate means such as a closure means on the valve 2 or any suitable gas sealing device such as a cap, etc.

In FIG. 3 the back of a refrigerator 9 is shown having tubes 4 which contain the Freon and valve 2 which is either built into tubes 4 near compressor 34 when the appliance (here its a refrigerator) is manufactured, or can be supplied later. If valve 2 is built in, it does not require a puncture means since it will be structured to be integral with the gas flow in tubes 4. If valve 2 is separate and not built in it must have a Freon tube puncture means 7 so that it can tap into tubes 4 when used. Container 1 can be located and stored in the back portion of refrigerator 9 before use. Container 1 is held in place by a container clamp 10 or other suitable means. When Freon is to be withdrawn from tubes 4, container 1 is removed from clamp 10, screwed onto valve 2 and screwed into tube 4 to activate valve 2 and cause Freon to flow through valve 2 into container 1. Container 1, as noted earlier, is preferably held under vacuum before use.

In FIG. 4 valve 2 is shown as it is connected onto container 1 before and after collecting Freon. Gas flow conduits or passages 30, 31, 32 and 33 (see FIG. 6) exist through valve 2 so that Freon can flow from tubes 4 into container 1. After collecting Freon from tubes 4 this gas flow conduit is sealed by any appropriate means such as plastic seals, plugs, etc. to prevent any escape of Freon from the container 1. Container 1 after collection is now ready to be brought to a Freon collection store for weighing and collection of deposit for the contained Freon.

As mentioned earlier, the preferred embodiment of the mechanism of tank 1 and valve 2 are shown above; however, in use, materials and structure may vary as the process is modified. Any suitable tank 1 or valve 2 based upon the requirements set forth herein may be used in the present invention.

Figure 5:
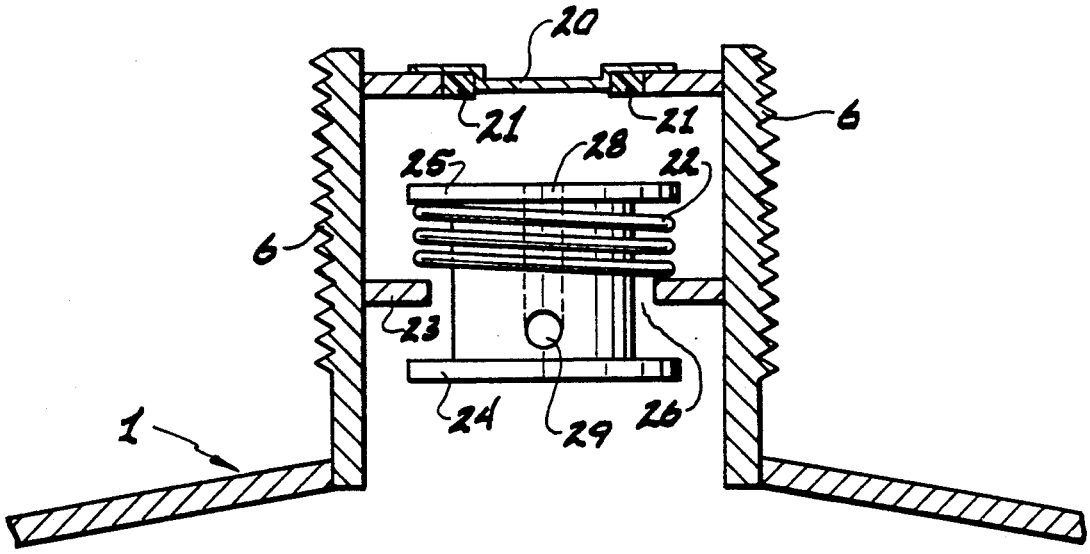
FIG. 5 is a side plan view of the interior top portion of the container of this invention.
Figure 6:
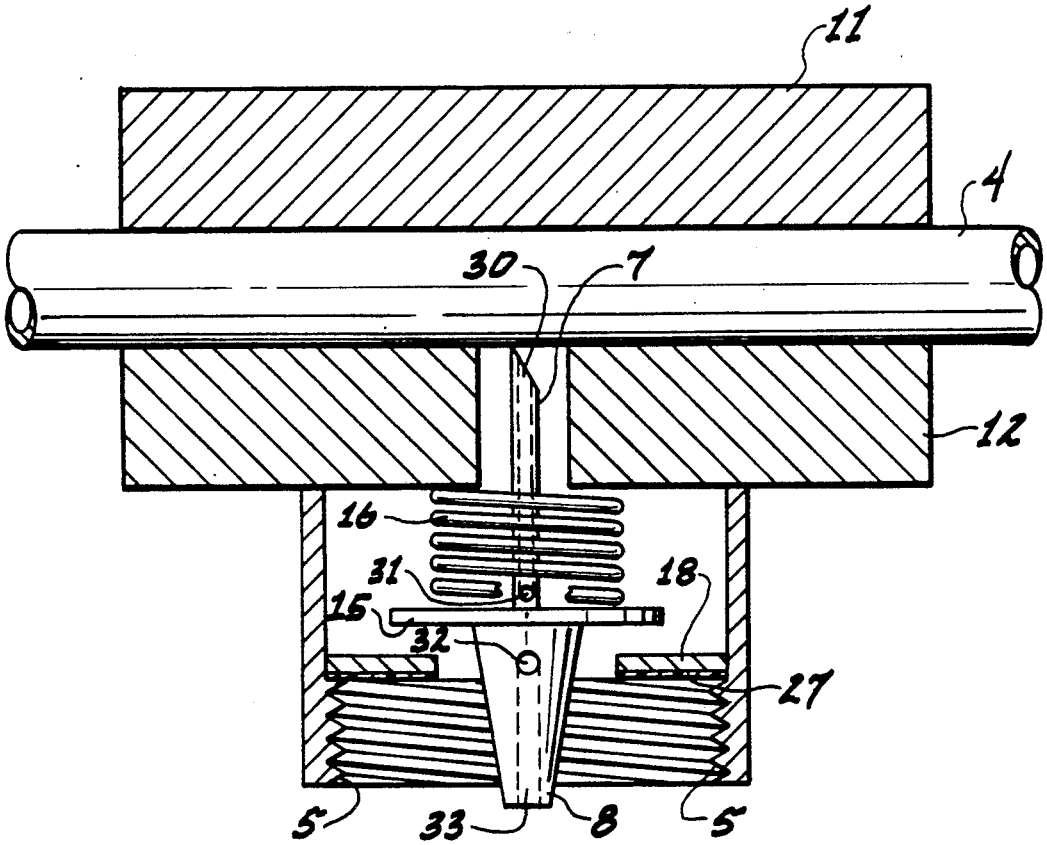
FIG. 6 is a side plan view of the valve of this invention as it is about to be connected to a Freon containing tube.

A specific tank top construction is shown in FIG. 5 and a specific valve construction is shown in FIG. 6 in the preferred embodiments. In FIG. 5 an uncoupled state (not connected to valve 2) seal 20 is used in the top portion of tank 1 to retain a state of vacuum in tank 1. It is made of any material such as plastic or aluminum or the like that will retain a state of vacuum in tank 1 yet still allow a puncture by tank conduit or mate 8. The outside of the top of tank 1 is threaded at 6 to receive a cap closure or a screw on valve 2.

Internal tank valve assembly 26 is shown in the open position to more clearly show its passages, however, in an uncoupled state it is closed. Valve gasket 24 mates to seat 23 to prevent Freon leakage (when filled with Freon). Valve gasket 24 is made of rubber or plastic or any substance that is inert to Freon and is capable of creating a gastight seal. Again, as mentioned above, threads 6 and 5 are either lefthanded or righthanded to differentiate and therefore prevent the intermix of different types of Freon. Gasket 21 is used to prevent vacuum and Freon loss while screwing tank 1 onto valve 2 and spring 22 is used to aid in closing tank valve assembly 26. In the tank valve assembly 26 there is a vertical passage 28 (indicated by dotted line) which is a gas flow conduit that, when valve assembly 26 is depressed, permits the passage of Freon out of aperture 29 into the tank.

In FIG. 6 valve 2 is also shown partially open in order to more clearly show its passages. However, in an uncoupled state it is usually closed. That is to say valve gasket 15 would be firmly placed on valve seat 18 by spring 16. This is intended to prevent the flow of any residual Freon after a puncture of the appliances tubing 4 and the bulk of the Freon had been removed to tank 1. Again, valve gasket 15 and gasket 27 are made of rubber, plastic, cork or any substance that is inert to Freon and is capable of making a gastight seal.

When tank 1 of FIG. 5 is first screwed (via threaded portions 5 of valve and threaded portion 6 of tank) onto valve 2 of FIG. 6 piercing means or conduit means 8 ruptures seal 20 of tank 1 and seals against gasket 21 which is made of rubber, nylon or any suitable material that is inert to Freon and makes a gastight seal. As tank 1 is continued to be screwed via threaded portions 6 onto valve 2 (threaded portions 5) tank conduit means 8 depresses internal valve assembly 26 until it opens, stops, and bottoms spring 22 against retainer 25. As tank 1 is continued to be screwed onto valve tank mate 8 is forced upward to open valve gasket 15 and seat 18 as well as force puncture needle 7 into the appliance tubing 4. When needle 7 punctures tubing 4 and valve 2 is opened, Freon may now flow down conduit 30 (in needle 7) out passage 31 around gasket 15 into passage 32 and down conduit 33 (in valve tank mate 8). It then when attached to tank 1 collects the Freon therein. When tank 1 is completely screwed into valve 2 its top seats against gasket 27 thereby accomplishing a gastight passage or conduit between appliance tubing 4 and tank 1. Any suitable device can be used to allow a minute amount of Freon to be removed from tank 1 and verify the presence of Freon in the container at the collection point. Any suitable halogen leak detector can be used to sample and verify the contents as being Freon such as T.I.F. Brand Model T.I.F. 5500.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A method for recycling Freon which comprises attaching a Freon removal valve to a Freon supply located in an appliance such as an air conditioner, refrigerator, freezer or the like, positioning a substantially empty Freon collecting vessel in gas flow relationship to said valve, drawing said Freon out of said Freon supply via said valve by providing said Freon removal valve with a puncture needle extending upwardly and adapted to puncture a Freon supply tubing in said appliance, below said puncture needle is positioned a spring means, and below said spring means is positioned a piercing means adapted to pierce a closure in said collecting vessel to thereby establish a gas passage means extending from said supply tube, through said needle, through said piercing means to said collecting vessel, collecting said Freon thereby in said collecting vessel, providing a substantially gas-free sealing means on said collecting vessel to insure substantial total containment of said Freon within said collecting vessel, and delivering said collecting vessel to a collection center for reuse and recycling of said Freon.

2. The method of claim 1 wherein the interior of said Freon collecting vessel is maintained under vacuum before and during the Freon removal step.

3. The method of claim 1 wherein said Freon collecting vessel is provided with connecting means to assist in forming a vacuum within said vessel.

4. The method of claim 1 wherein said Freon removal valve is attached. to said Freon collecting vessel and subsequently attached in gas flow relationship to said Freon supply.

5. The method of claim 1 wherein said Freon removal valve is provided with a Freon sensor, said Freon sensor used to verify the presence of Freon in said Freon collecting vessel after a Freon removal step.

6. The method of claim 1 wherein said Freon collecting vessel has a uniform weight, thereby providing means for determining the Freon content of said Freon collecting vessel upon weighing after a Freon removal step.

7. A Freon recovery kit comprising a Freon removal valve and a Freon collection vessel, said Freon removal valve having means to attach onto said Freon collection vessel in a gas tight manner, said Freon removal valve having means for providing Freon flow from an appliance with a source of Freon through said Freon removal valve, said Freon removal valve comprising a puncture needle extending upwardly and adapted to puncture a Freon supply tubing in said appliance, below said puncture needle is positioned a spring means, and below said spring means is a piercing means adapted to pierce a closure in said collecting vessel to thereby establish a gas passage means extending from said supply tube, through said needle, through said piercing means, and ultimately to said collecting vessel, said Freon collection vessel having a sealing means to provide a substantially gas tight seal to minimize the escape of Freon contained therein.

8. The Freon recovery kit of claim 7 wherein said Freon removal valve is used with a sensor means for indicating and verifying the presence of Freon in said Freon collection vessel when said valve is attached to said collection vessel.

9. The Freon recovery kit of claim 7 wherein said Freon removal valve has a safety seal that requires destruction upon usage of said valve.

* * * * *